US007330157B2

(12) United States Patent
Sugawara

(10) Patent No.: US 7,330,157 B2
(45) Date of Patent: Feb. 12, 2008

(54) ANTENNA DEVICE HAVING WIDE OPERATION RANGE WITH A COMPACT SIZE

(75) Inventor: Satoru Sugawara, Sendai (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 11/486,231

(22) Filed: Jul. 12, 2006

(65) Prior Publication Data

US 2007/0013597 A1 Jan. 18, 2007

(30) Foreign Application Priority Data

Jul. 13, 2005 (JP) ..... 2005-204642
Jul. 19, 2005 (JP) ..... 2005-209267

(51) Int. Cl.
*H01Q 9/00* (2006.01)

(52) U.S. Cl. ..... 343/750; 343/773

(58) Field of Classification Search ..... 343/750, 343/773, 846

See application file for complete search history.

(56) References Cited

U.S. PATENT DOCUMENTS 7,002,527 B2 2/2006 Sugawara
7,158,086 B2 * 1/2007 Inatsugu et al. ..... 343/711
2006/0284779 A1 * 12/2006 Parsche et al. ..... 343/773

FOREIGN PATENT DOCUMENTS

| | | |
|---|---|---|
| JP | 06-350334 | 12/1994 |
| JP | 10-154911 | 6/1998 |
| JP | 2001-024431 | 1/2001 |
| JP | 2004-304785 | 10/2004 |

* cited by examiner

*Primary Examiner*—Tan Ho
(74) *Attorney, Agent, or Firm*—Cooper & Dunham LLP

(57) ABSTRACT

This patent specification describes an antenna device which includes a non-directional antenna having a radiating element and a ground plate, a coaxial line configured to feed an electromagnetic power to the non-directional antenna, a dielectric film arranged on the ground plate, including a dielectric material, a short circuit line arranged on the dielectric film, formed of a conductive pattern and configured to connect an inner conductor of the coaxial line to an outer conductor of the coaxial line and a switch arranged at a portion of the short circuit line to switch a state between a non-shorted state and a shorted state.

11 Claims, 15 Drawing Sheets

ANTENNA DEVICE HAVING WIDE OPERATION RANGE WITH A COMPACT SIZE

FIELD

This patent specification describes an antenna device having wide operation range with a compact size.

BACKGROUND

Recent rapid development of a radio communication technology realizes a variety of products in communication areas such as mobile phone and an information terminal equipped with a variable-directivity antenna. In the radio communication areas, it is highly expected to increase a transmission capacity due to a necessity to handle more complicated and larger data. Many researches and studies have recently been made to attempt an increase of transmission capacity, particularly, by multiplexing various signals of different dimensions, such as, for example, time, space, polarized waves and codes.

Multiplexing with space, in particular, can ideally be made with an adaptive array antenna having a plurality of a nondirectional antennas and a circuit for synthesizing vectors of signals from the plurality of nondirectional antennas. The adaptive array antenna has inherent disadvantages in a practical usage due to facts that each antenna has a relatively large size and that two adjacent antennas are spaced with a relatively large distance.

An antenna is expected to be as small as possible, especially, in a mobile application area. The variable-directivity antenna is generally made of a pair of an antenna and a power supply circuit and is capable of varying directivity. Such a variable-directivity antenna is believed to be made in a size smaller than the adaptive array antenna and is therefore expected to be a promising candidate for a compact antenna that realizes multiplexing with space. However, only a few studies have been announced on a compact variable-directivity antenna device.

FIG. 1 illustrates an oblique perspective view of a known variable-directivity antenna device. The variable-directivity antenna includes an antenna element 101, a reflecting element 102 and a reflecting element moving means 103. The reflecting element 102 is arranged in parallel to the antenna element 101. The reflecting element moving means 103 includes a rotation drive portion 103*a* and a connection arm 103*b* so that the reflecting element 102 moves along a circular-arc around an axial line of the antenna element 101. The reflecting element 102 is arranged perpendicularly via an insulator (not shown) on the rotation drive portion 103*a*.

The rotation drive portion 103*a* is attached on a conductor 104, for example, a car body. Further, the reflecting element 102 is connected via the reflecting element moving means 103. A coaxial line 105 connects electrically the antenna element 101 to a power supply 106. Therefore, the antenna element 101 directs the directivity in a specific direction by adjusting a positional relationship between the antenna element 101 and the reflecting element 102. However, a size of the antenna device is large due to an installation of the reflecting element 102.

FIG. 2 illustrates an oblique perspective view of another known variable-directivity antenna device. The variable-directivity antenna device includes a circular ground plate 111, a single center monopole 112 and parasitic elements 113. The parasitic elements 113 are arranged to surround the single center monopole 112. An impedance load 114 is arranged under a part of the parasitic element 113. A directivity of the antenna device is changed by changing a state of the impedance of the parasitic element 114. However, an interval between the single center monopole 112 and the parasitic element 113 is limited to be λ/4. As a result, the antenna size becomes large and a whole size of the antenna device is more than 2λ.

FIG. 3 illustrates an oblique perspective view of another known variable-directivity antenna device 115. The variable-directivity antenna 115 includes a radiating element A0 and variable reactance elements A1 to A6 and a circular ground plate 116. A radio signal is fed to the radiating element A0. The variable reactance elements A1 to A6 are radially arranged to surround the radiating element A0. However, an interval d between the radiating element A0 and the variable reactance elements A1 to A6 is to be λ/4. As a result, a size of the antenna device 115 becomes large and is more than λ. As described, the proposed variable-directivity antenna devices are larger than the non-directional antenna device.

FIG. 4A illustrates a cross-sectional view of another known variable-directivity antenna device 120. FIG. 4B illustrates a top view of a part of the known antenna device 120 of FIG. 4A. The antenna device 120 is a disk-corn-shaped antenna having a radiating element 121 and a ground plate 123. The antenna device 120 is a non-directional antenna to which an electromagnetic power is fed by a coaxial line 124.

FIG. 5 illustrates a return loss characteristic of the variable-directivity antenna device 120 of FIG. 4A. Similar values of the return loss are obtained in a wide range independent of the existence of the short circuit. However, the return loss is increased in a range below a frequency of 10 GHz. An inductance due to the short circuit is increasing perpendicular to the increase of the frequency. However, the inductance in the range of the frequency of 10 GHz is not large enough to affect an inductance of the antenna device.

FIG. 6 illustrates a cross-sectional view of another known variable-directivity antenna device 130. The antenna device 130 includes a coaxial line 134, an inner conductor 134*a*, an outer conductor 134*b*, short-circuit 131, switches 133 and a capacitor 135 on a ground plate 137. The short-circuit line 131 shorts the inner conductor 134*a* and the outer conductor 134*b* of the coaxial line 134. The switch 133 switches a state between a shorted state and a non-shorted state. In the antenna device 130, wirings are eliminated using flip chip methodology in an assembly process so as to improve accuracy with less difference among antenna devices.

FIG. 7 illustrates a cross-sectional view of the variable-directivity antenna device 130 of FIG. 6 with wirings to make a short-circuit in a shorted state. FIG. 8 illustrates a cross-sectional view of the variable-directivity antenna device 130 of FIG. 6 with no wiring.

There is a need for a variable-directivity antenna having a wide operating range with a similar size to a non-directional antenna device.

SUMMARY

This patent specification describes a novel antenna device which includes a non-directional antenna having a radiating element and a ground plate, a coaxial line configured to feed an electromagnetic power to the non-directional antenna, a dielectric film arranged on the ground plate, including a dielectric material, a short circuit line arranged on the dielectric film, formed of a conductive pattern and configured to connect an inner conductor to an outer conductor of the coaxial line and a switch arranged at a portion of the short circuit line to switch a state between a non-shorted state and a shorted state.

This patent specification further describes a novel antenna device which includes a non-directional antenna having a radiating element and a ground plate, a coaxial line configured to feed an electromagnetic power to the non-directional antenna, a dielectric film arranged on the ground plate and formed of dielectric material, a short circuit line arranged on the dielectric film, formed of a conductive pattern and configured to connect an inner conductor to an outer conductor of the coaxial line and a capacitor configured to connect an outer portion of the short circuit to the ground plate at a radio frequency at a position outside an outer conductor of the coaxial line from the center of the coaxial line over the ground plate.

Further, this patent specification describes a novel antenna device which includes a non-directional antenna having a radiating element and a ground plate, a coaxial line configured to feed an electromagnetic power to the non-directional antenna, a short circuit line arranged on a dielectric film, formed of a conductive pattern and having a length substantially longer than an interval between an inner conductor and an outer conductor of the coaxial line and a switch arranged at a portion of the short circuit to switch a state between a non-shorted state and a shorted state.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
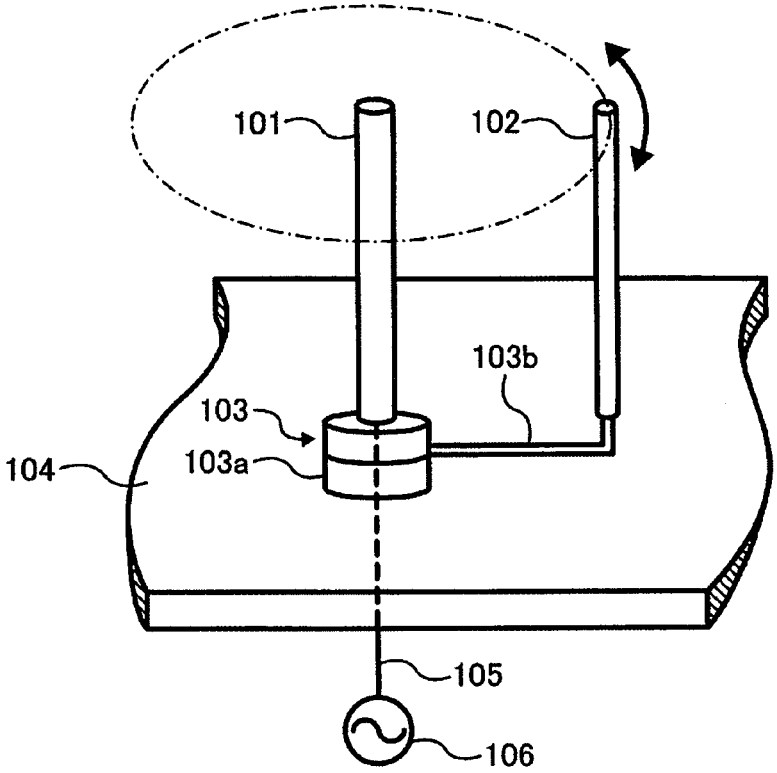
FIG. 1 BACKGROUND ART
FIG. 1 illustrates a known variable-directivity antenna device.
Figure 2:
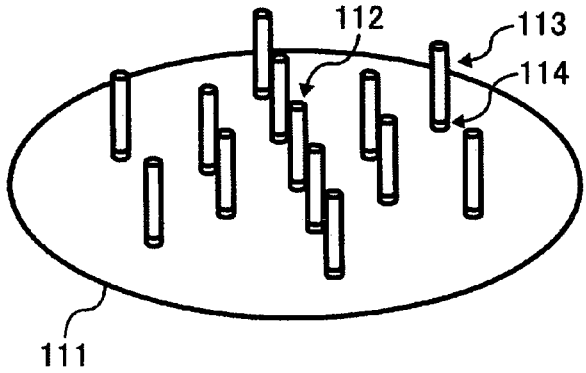
FIG. 2 BACKGROUND ART
FIG. 2 illustrates another known variable-directivity antenna device.
Figure 3:
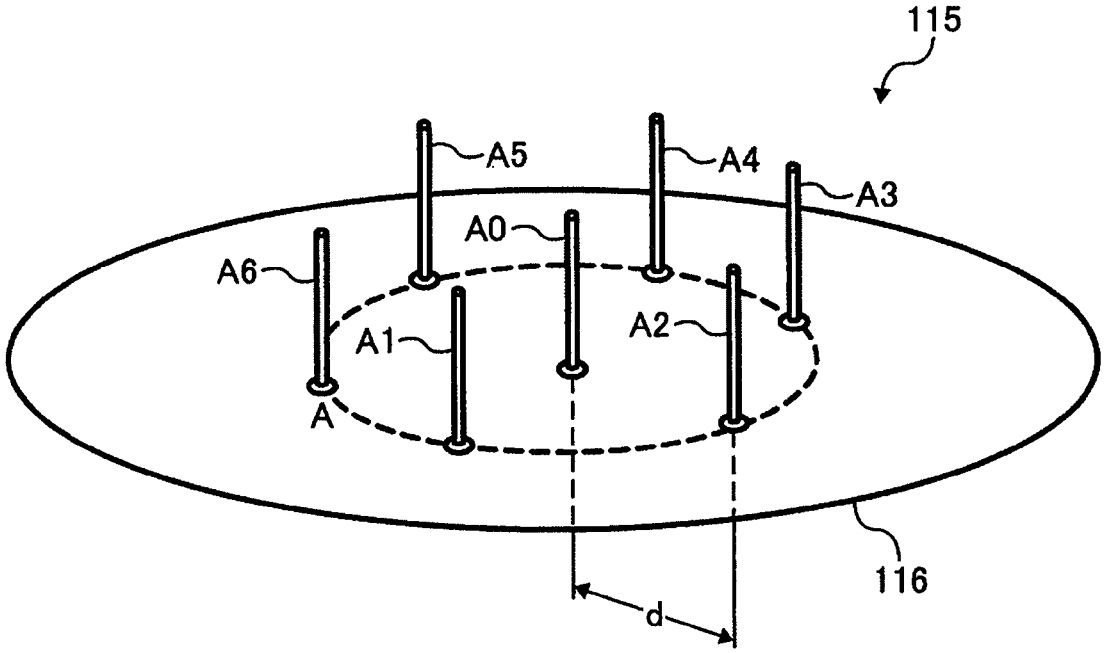
FIG. 3 BACKGROUND ART
FIG. 3 illustrates another known variable-directivity antenna device.
Figure 4A:
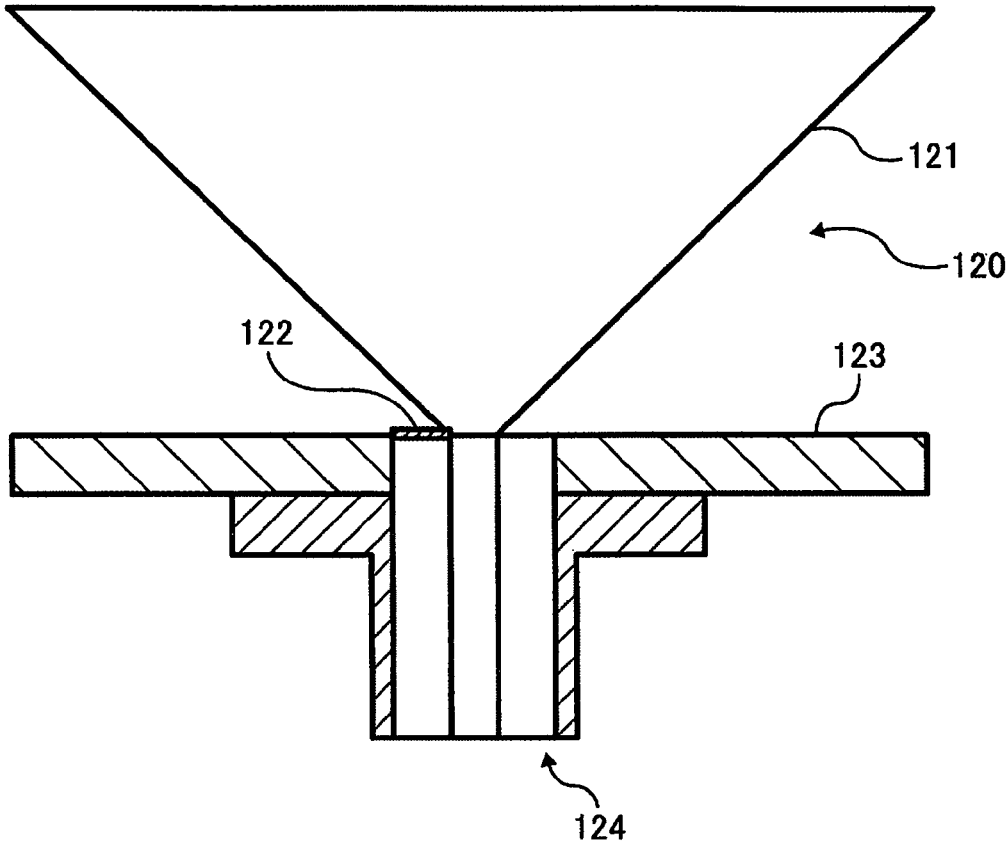
FIG. 4A BACKGROUND ART
FIG. 4A illustrates an oblique perspective view of another known variable-directivity antenna device.
Figure 4B:
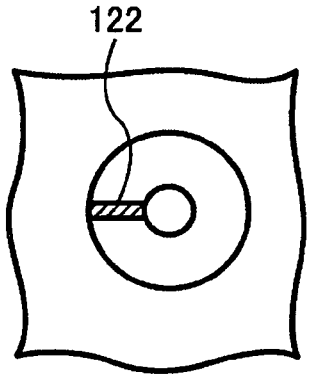
FIG. 4B BACKGROUND ART
FIG. 4B illustrates a top view of a part of the antenna device of FIG. 4A.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 9A, 9B, 13A, 13B, 14A and 14B, antenna devices according to exemplary embodiments are described.

Figure 9A:
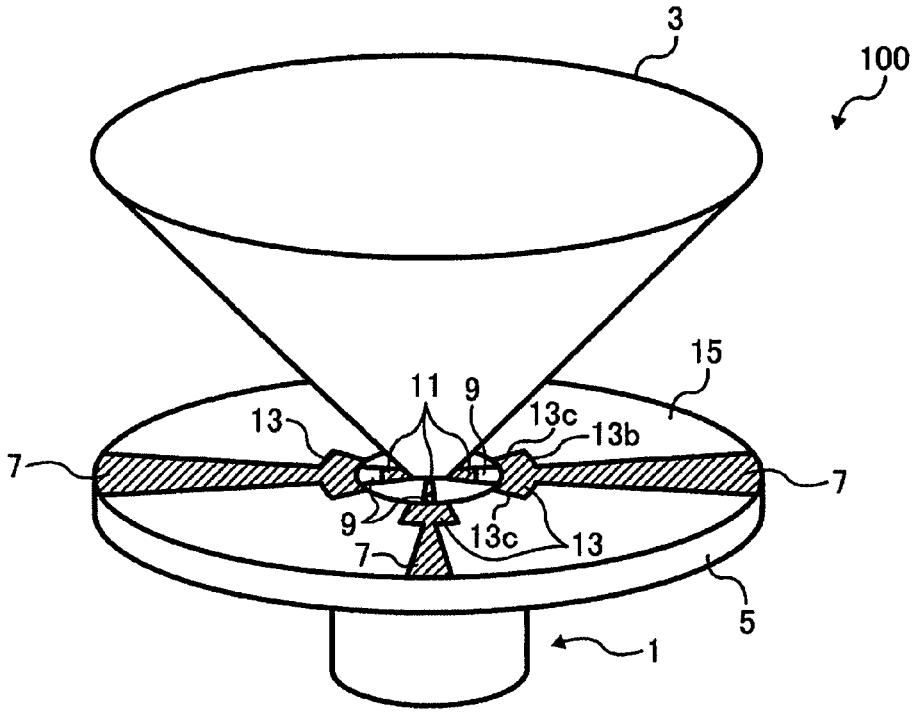
FIGS. 9A and 9B illustrate a relevant part of an antenna device according to a first exemplary embodiment.
Figure 9B:
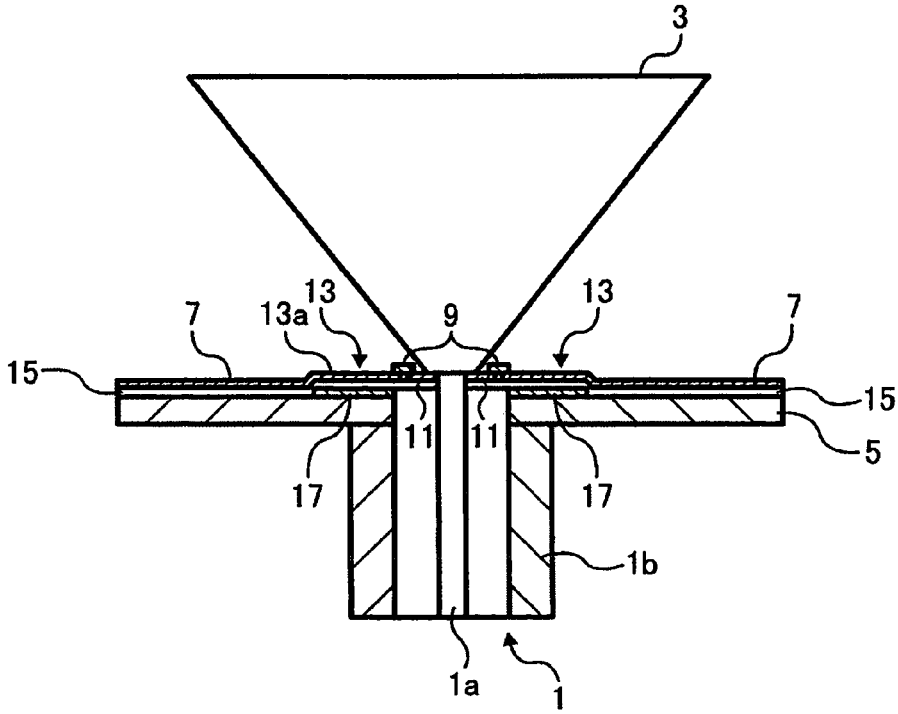

FIGS. 9A and 9B illustrate a relevant part of an antenna device 100 according to a first exemplary embodiment. FIG. 9A illustrates an oblique perspective view of the antenna device 100 according to the first exemplary embodiment. FIG. 9B illustrates a cross-sectional view of the antenna device 100 of FIG. 9A. The antenna device 100 is a disk-corn-shaped antenna having a radiating element 3 and a ground plate 5. The antenna device 100 is a variable-directional antenna to which an electromagnetic power is fed by a coaxial line 1.

The antenna device 100 further includes a dielectric film 15, short-circuit lines 11, switches 9 and capacitors 13. The dielectric film 15 includes a dielectric material and is arranged on the ground plate 5. The short-circuit line 11 shorts an inner conductor 1*a* and an outer conductor 1*b* of the coaxial line 1. Each switch 9 is arranged at a portion of the short-circuit line 11 and switches a state between a shorted state and a non-shorted state. The capacitor 13 connects the short-circuit line 11 to the ground plate 5 at a radio frequency.

Namely, a connection portion between the radiating element 3 and the coaxial line 1 comprises bias lines 7, the switches 9, the short-circuit lines 11 and the dielectric film 15 on the ground plate 5. An electrode 13*a* of the capacitor 13 is formed on the dielectric film 15. The switches 9 can selectively be turned ON or OFF with the short-circuit lines 11 in four directions.

The capacitor 13 further includes other electrode 17 in addition to the electrode 13*a* and the dielectric film 15. The electrodes 13*a* and 17 are formed of metal pattern on the dielectric film 15. The electrodes 13*a* is made in a process in which the short circuit line 11 is made. An outline pattern of the capacitor 13 includes a circular arc portion 13*b* which is circular about a center of the coaxial line 1 and a linear shape portion 13*c* which is expanding in a radiating direction. The capacitor 13 is closely located to the coaxial line 1, but is configured to have a space between each capacitor element so as not to prevent a current flow on the ground plate 5, which contributes radiation.

In this exemplary embodiment, a PIN (p-type, intrinsic, n-type) diode is used as the switch 9. The switches 9 can be controlled to turn ON or OFF with the short-circuit lines 11 from an outside of the antenna device 100 through bias lines 7. When all of the switches are turned OFF, a radiation pattern of the antenna device 100 remains non-directional because there is no disturbance to the electric field of the coaxial line 1.

When one of the switches is turned ON, the radiation pattern of the antenna device 100 obtains a directivity because the electric field of the coaxial line 1 is disturbed. The directivity of the antenna 100 can be switched by switching the switches 9.

Figure 9C:
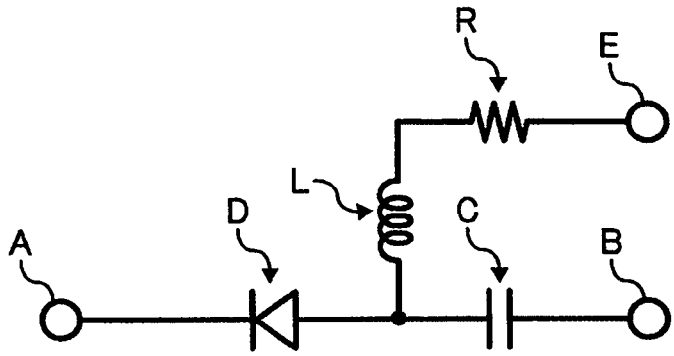
FIG. 9C illustrates an example of an equivalent circuit of a switch of FIG. 9A.

FIG. 9C illustrates an example of an equivalent circuit of the switch 9 of FIG. 9A and 9B. In FIG. 9C, symbols A, B, and E show terminals, a symbol D shows the PIN diode, a symbol C shows the capacitor 13, a symbol L shows inductance and a symbol R shows a resistance. The terminal A is connected to a signal line of the coaxial line 1. The terminal B is connected to a ground line of the coaxial line 1. The terminal E is connected to the bias line 7 formed on the dielectric film 15. The PIN diode D is connected to the ground by the capacitor C at a radio frequency. The PIN diode D performs a switching operation by utilizing a large change of a resistance value of the PIN diode D in accordance with a change of a DC bias value applied to the terminal E.

Figure 9D:
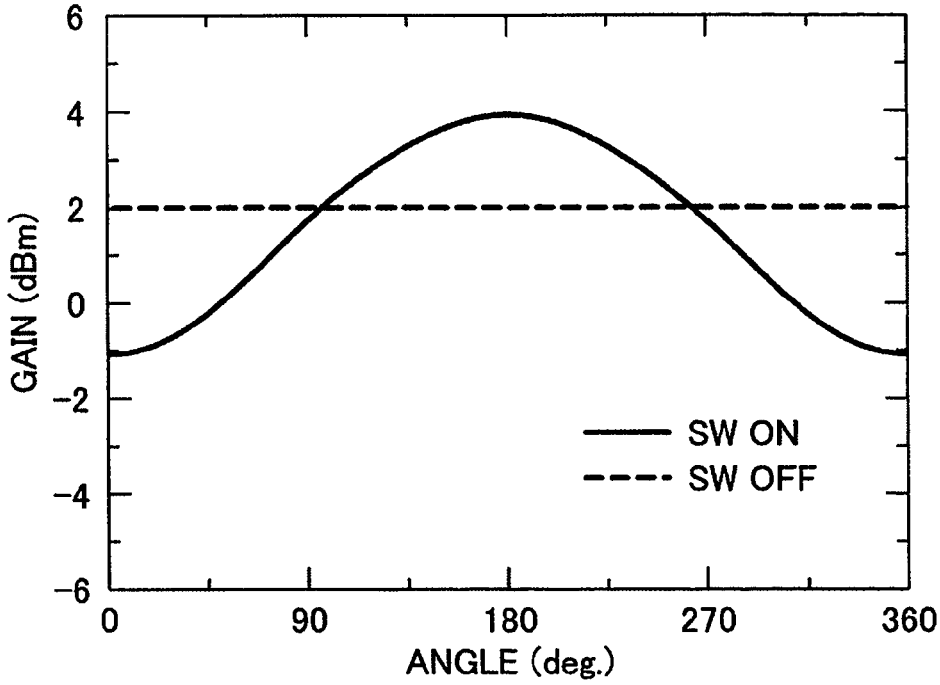
FIG. 9D illustrates a characteristics of the antenna device to explain the directivity of the variable-directional antenna device of FIG. 9A.

FIG. 9D illustrates characteristics of the antenna device 100 to explain the directivity of the variable-directional antenna device 100 according to the first exemplary embodiment. In FIG. 9D, antenna gain characteristics at an angle of 45 degree from the ground plate 5 are illustrated for a 360-degree field around the radiator when a base angle (0 degree) is determined at a direction of a switch 9 which is turned ON.

In FIG. 9D, a solid line shows an antenna gain characteristic when one switch 9 located on a line of the base angle (0 degree) is turned ON. A dotted line shows the antenna gain characteristic when all of the switches 9 are turned OFF. Referring to FIG. 9D, the antenna gain is found to be a constant value at any angle. Further, a radiation pattern of the antenna device 100 is non-directional when all of the switches 9 are turned OFF.

The radiation pattern of the antenna device 100 is changed by turning a predetermined switch 9 ON. A radiation intensity of the antenna device 100 becomes strong when the switch 9 at an opposite side is turned ON. Thus, a radiation direction of the antenna device 100 having a similar size to a common non-directional antenna can be changed.

Because the variable-directional antenna 100 according to the first exemplary embodiment includes the capacitor 13 formed with the dielectric film 15, the variable-directional antenna 100 having a similar size to the common non-directional antenna may be possible to operate in a similar frequency range to the common non-directional antenna. Moreover, the characteristics of the antenna is improved by eliminating wiring to make a contact with the coaxial line 1. Further, an assembly process becomes simple so that a cost reduction can be achieved.

Figure 10A:
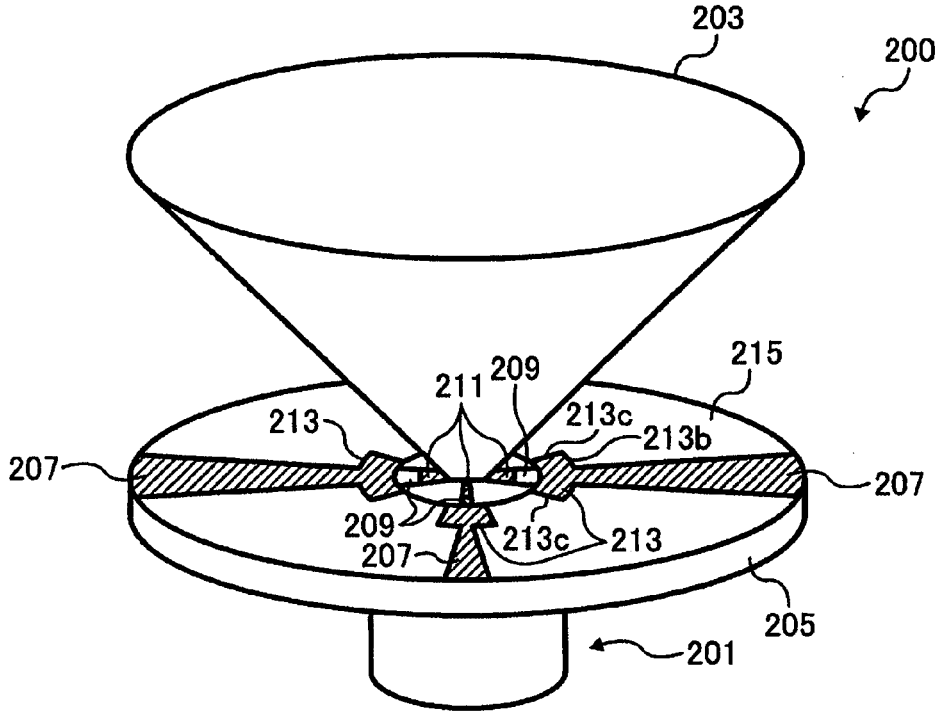
FIGS. 10A and 10B illustrate a relevant part of an antenna device according to a second exemplary embodiment.
Figure 10B:
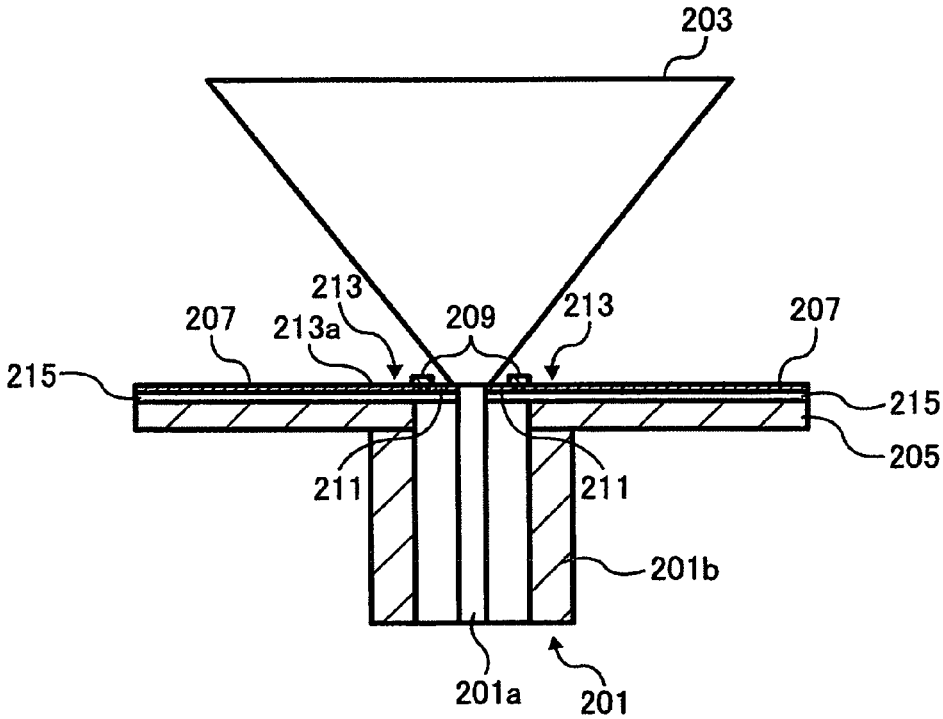

FIGS. 10A and 10B illustrate a relevant part of an antenna device 200 according to a second exemplary embodiment. FIG. 10A illustrates an oblique perspective view of the antenna device 200 according to the second exemplary embodiment. FIG. 10B illustrates a cross-sectional view of the antenna device 200 of FIG. 10A. The antenna device 200 is a disk-corn-shaped antenna having a radiating element 203 and a ground plate 205. The antenna device 200 is a variable-directional antenna to which an electromagnetic power is fed by a coaxial line 201.

The antenna device 200 further includes a dielectric film 215, short-circuit lines 211, switches 209 and capacitors 213. The dielectric film 215 includes a dielectric material and is arranged on the ground plate 205. The short-circuit line 211 shorts an inner conductor 201*a* and an outer conductor 201*b* of the coaxial line 201. The switch 209 is arranged at a portion of the short-circuit line 211 and switches a state between a shorted state and a non-shorted state. The capacitor 213 connects the short-circuit line 211 to the ground plate 205 at a radio frequency.

Namely, a connection portion between the radiating element 203 and the coaxial line 201 comprises bias lines 207, the switches 209, the short-circuit lines 211 and the dielectric film 215 on the ground plate 205. An electrode 213*a* of the capacitor 213 is formed on the dielectric film 215. The switches 209 can selectively be turned ON or OFF with the short-circuit lines in four directions.

In this second exemplary embodiment, the capacitor 213 is formed with the electrode 213*a*, the dielectric film 215 and a part of the ground plate 205. The electrodes 213*a* is formed of metal pattern on the dielectric film 215. The electrodes 213*a* is made in a process in which the short circuit line 211 is made. The other electrode is formed with a part of the ground plate 205. An outline pattern of the capacitor 213 includes a circular arc portion 213*b* which is circular about a center of the coaxial line 201 and a linear shape portion 213*c* which is expanding in a radiating direction. The capacitor 213 is closely located to the coaxial line 201, but is configured to have a space between each capacitor element so as not to prevent a current flow on the ground plate 205, which contributes radiation.

In this exemplary embodiment, a PIN diode is used as the switch 209. The switches 209 can be controlled to turn ON or OFF with the short-circuit lines 211 from an outside of the antenna device 200 through the bias lines 207. When all of the switches are turned OFF, a radiation pattern of the antenna device 200 remains non-directional because there is no disturbance to the electric field of the coaxial line 201.

When one of the switches is turned ON, a radiation pattern of the antenna device 200 has a directivity because the electric field of the coaxial line 201 is disturbed. The directivity of the antenna 200 can be switched by switching the switches 209. Because the variable-directional antenna 200 according to the second exemplary embodiment includes the capacitor 213 formed with the dielectric film 215, the variable-directional antenna 200 having a similar size to the common non-directional antenna may be possible to operate in a similar frequency range to the common non-directional antenna.

Figure 11A:
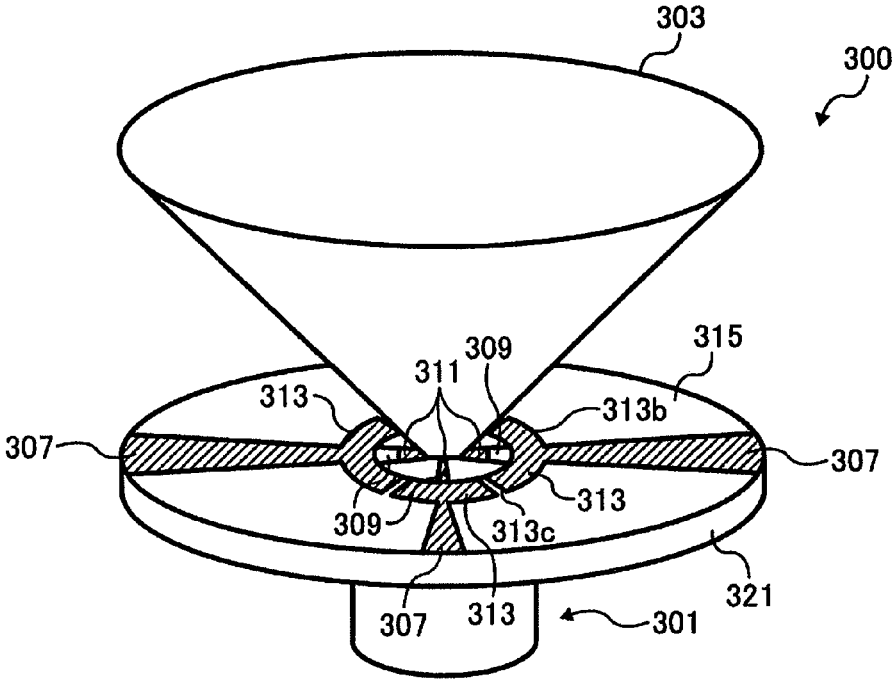
FIGS. 11A and 11B illustrate a relevant part of an antenna device according to a third exemplary embodiment.
Figure 11B:
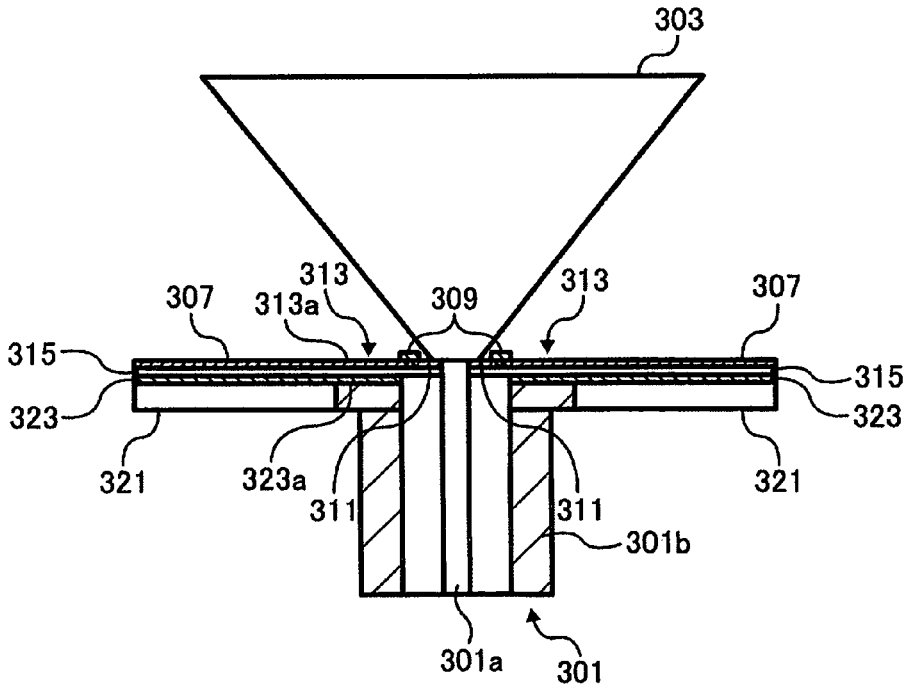

FIGS. 11A and 11B illustrate a relevant part of an antenna device 300 according to a third exemplary embodiment. FIG. 11A illustrates an oblique perspective view of the antenna device 300 according to the third exemplary embodiment. FIG. 11B illustrates a cross-sectional view of the antenna device 300 of FIG. 11A. The antenna device 300 is a disk-corn-shaped antenna having a radiating element 303 and a ground plate 305. The antenna device 300 is a variable-directional antenna to which an electromagnetic power is fed by a coaxial line 301.

The antenna device 300 further includes a dielectric film 315, short-circuit lines 311, switches 309 and capacitors 313. The dielectric film 315 includes a dielectric material and is arranged on the ground plate 305. The short-circuit line 311 shorts an inner conductor 301*a* and an outer conductor 301*b* of the coaxial line 301. The switch 309 is arranged at a portion of the short-circuit line 311 and switches a state between a shorted state and a non-shorted state. The capacitor 313 connects the short-circuit line 311 to the ground plate 305 at a radio frequency.

Namely, a connection portion between the radiating element 303 and the coaxial line 301 comprises bias lines 307, the switches 309, the short-circuit lines 311 and the dielectric film 315 on a support plate 321. An electrode 313*a* of the capacitor 313 and a ground plate 323 are formed on the dielectric film 315. The ground plate 323 is formed by extending the other electrode 323*a*. The switches 309 can selectively be turned ON or OFF with the short-circuit lines in four directions.

The capacitor 313 further includes other electrode 323*a* in addition to the electrode 313*a* and the dielectric film 315. The electrodes 313*a* and 323*a* are formed of metal pattern on the dielectric film 315. The electrodes 313*a* is made in a process in which the short circuit line 311 is made. An outline pattern of the capacitor 313 includes a circular arc portion 313*b* which is circular about a center of the coaxial line 301 and a linear shape portion 313*c* which is expanding in a radiating direction. The capacitor 313 is closely located to the coaxial line 301, but is configured to have a space between each capacitor element so as not to prevent a current flow on the ground plate 305, which contributes radiation. A circumferential length of the circular arc portion 313*b* is longer than the circumferential length of the circular arc portion of the first and second exemplary embodiments.

In this exemplary embodiment, a PIN diode is used as the switch 309. The switches 309 can be controlled to turn ON or OFF with the short-circuit lines 311 from an outside of the antenna device 300 through the bias lines 307. When all of the switches are turned OFF, a radiation pattern of the antenna device 300 remains non-directional because there is no disturbance to the electric field of the coaxial line 301.

When one of the switches is turned ON, the radiation pattern of the antenna device 300 possess a directivity because the electric field of the coaxial line 301 is disturbed. The directivity of the antenna 300 can be switched by switching the switches 309. Because the variable-directional antenna 300 according to the third exemplary embodiment includes the capacitor 313 formed with the dielectric film 315, the variable-directional antenna 300 having a similar size to the common non-directional antenna may be possible to operate in a similar frequency range to the common non-directional antenna.

Figure 12A:
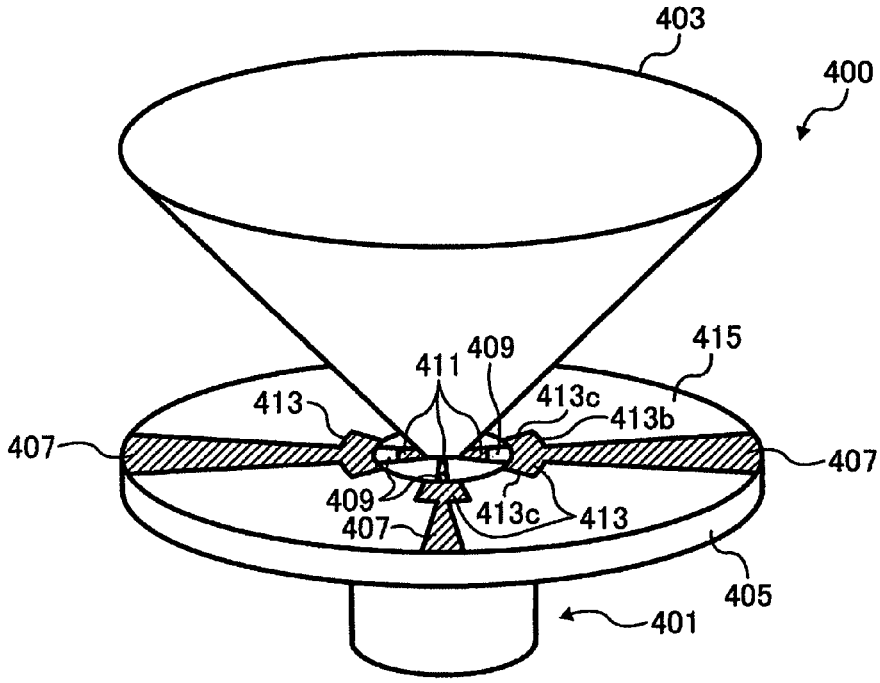
FIGS. 12A and 12B illustrate a relevant part of an antenna device according to a fourth exemplary embodiment.
Figure 12B:
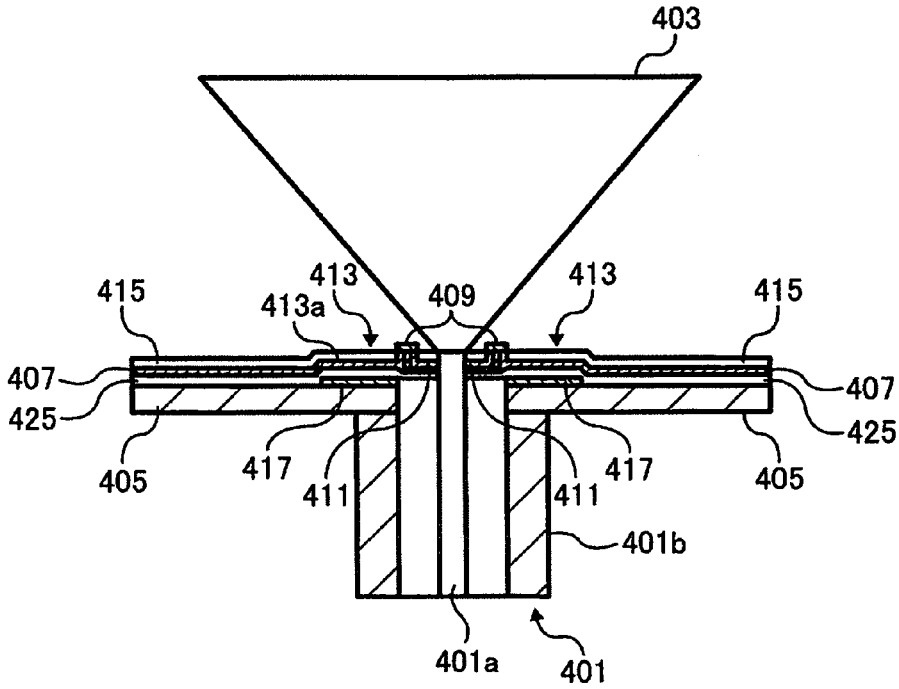

FIGS. 12A and 12B illustrate a relevant part of an antenna device 400 according to a fourth exemplary embodiment. FIG. 12A illustrates an oblique perspective view of the antenna device 400 according to the fourth exemplary embodiment. FIG. 12B illustrates a cross-sectional view of the antenna device 400 of FIG. 12A. The antenna device 400 is a disk-corn-shaped antenna having a radiating element 403 and a ground plate 405. The antenna device 400 is a variable-directional antenna to which an electromagnetic power is fed by a coaxial line 401.

The antenna device 400 further includes a dielectric film 415, short-circuit lines 411, switches 409 and capacitors 413. The dielectric film 415 includes a dielectric material and is arranged on the ground plate 405. The short-circuit line 411 shorts an inner conductor 401*a* and an outer conductor 401*b* of the coaxial line 401. The switch 409 is arranged at a portion of the short-circuit line 411 and switches a state between a shorted state and a non-shorted state. The capacitor 413 connects the short-circuit line 411 to the ground plate 405 at a radio frequency. Namely, a connection portion between the radiating element 403 and the coaxial line 401 comprises bias lines 407, the switches 409, the short-circuit lines 411 and the dielectric film 415 on the ground plate 405.

The capacitor 413 includes the electrode 413*a*, other electrode 417 and a thin dielectric film 425. The electrodes 413*a* is formed of metal pattern on a lower side of the dielectric film 415 and is made in a process in which the short circuit line 411 is made. The thin dielectric film 425 is thinner than the dielectric film 415 so that larger capacity value is obtained with a similar capacitor area using the dielectric film 415. The thin dielectric film 425 is formed on the grand plate 405.

An outline pattern of the capacitor 413 includes a circular arc portion 413*b* about a center of the coaxial line 401 and a linear shape portion 413*c* which is expanding in a radiating direction. The capacitor 413 is closely located to the coaxial line 401, but is configured to have a space between each capacitor element so as not to prevent a current flow on the ground plate 405, which contributes radiation.

In this exemplary embodiment, a PIN diode is used as the switch 409. The switches 409 can be controlled to turn ON or OFF with the short-circuit lines 411 from an outside of the antenna device 400 through the bias lines 407. When all of the switches are turned OFF, a radiation pattern of the antenna device 400 remains non-directional because there is no disturbance to the electric field of the coaxial line 401.

When one of the switches is turned ON, the radiation pattern of the antenna device 400 attains a directivity because the electric field of the coaxial line 401 is disturbed. The directivity of the antenna 400 can be switched by switching the switches 409. Because the variable-directional antenna 400 according to the fourth exemplary embodiment includes the capacitor 413 formed with the dielectric film 415, the variable-directional antenna 400 having a similar size to the common non-directional antenna may be possible to operate in a similar frequency range to the common non-directional antenna.

Figure 13A:
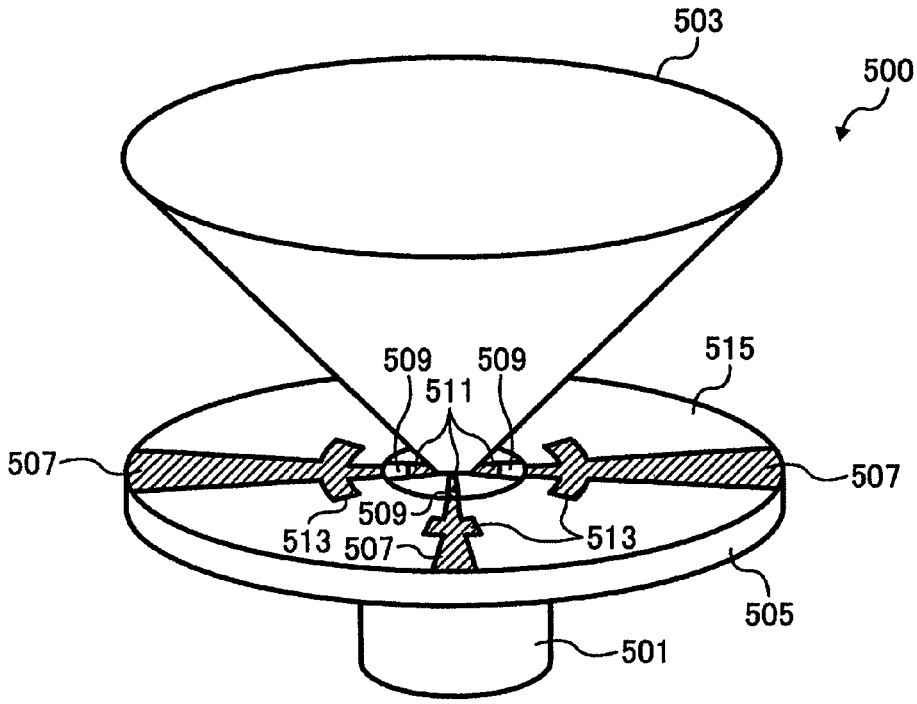
FIGS. 13A and 13B illustrate a relevant part of an antenna device according to a fifth exemplary embodiment.
Figure 13B:
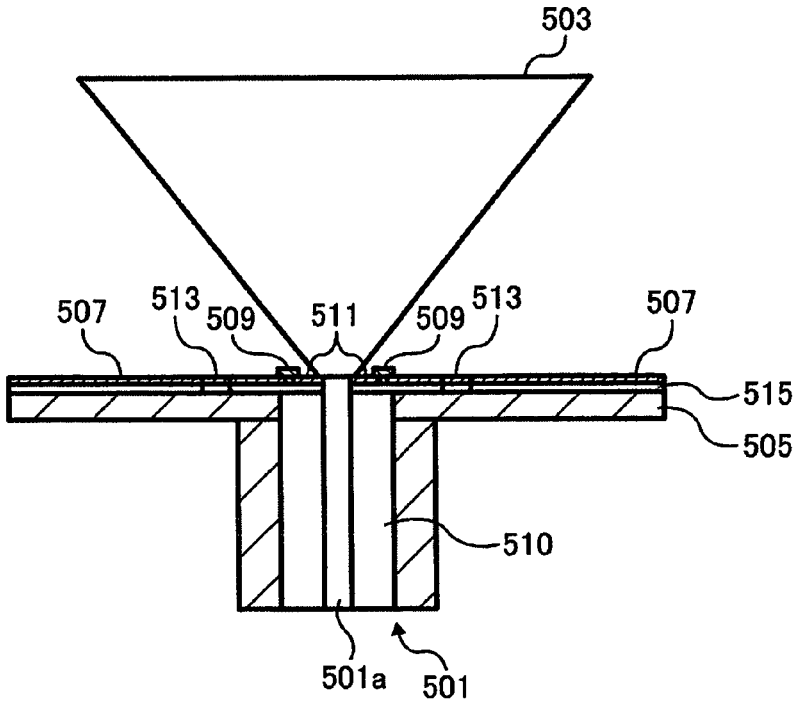

FIGS. 13A and 13B illustrate a relevant part of an antenna device 500 according to a fifth exemplary embodiment. FIG. 13A illustrates an oblique perspective view of the antenna device 500 according to the fifth exemplary embodiment. FIG. 13B illustrates a cross-sectional view of the antenna device 500 of FIG. 13A. The antenna device 500 is a disk-corn-shaped antenna having a radiating element 503 and a ground plate 505. The antenna device 500 is a variable-directional antenna to which an electromagnetic power is fed by a coaxial line 501.

On the ground plate 505, bias lines 507, switches 509, short-circuit lines 511 and a dielectric film 515 are arranged. The dielectric film 515 includes a dielectric material and is attached on the ground plate 505. The short-circuit line 511 shorts an inner conductor 501*a* and an outer conductor 501*b* of the coaxial line 501. The switch 509 is arranged at a portion of the short-circuit line 511 and switches a state between a shorted state and a non-shorted state. An electrode 513*a* of a capacitor 513 is formed on the dielectric film 515. The switches 509 can selectively be turned ON or OFF with the short-circuit lines 511 in four directions at a connection portion between the radiating element 503 and the coaxial line 501. The capacitor 513 is formed with a metal pattern on the dielectric film 515, an electrode, the dielectric film 515 and the ground plate 505.

An outline pattern of the capacitor 513 includes a circular arc portion 513*b* which is circular about a center of the coaxial line 501 and a linear shape portion 513*c* which is expanding in a radiating direction. The capacitor 513 is closely located to the coaxial line 501, but is configured to have a space between each capacitor element so as not to prevent a current flow on the ground plate 505, which contributes radiation.

In terms of a radio frequency, a grounded point of the short-circuit line 511 at a side of an outer conductor 510 of the coaxial line 501 is located at a connection point to the capacitor 513. Namely, the grounded point of the short-circuit line 511 is located at a position which is outside of outer conductor 510 of the coaxial line 501 from the center of the coaxial line 501 and over the ground plate 505. In the configuration of the fifth exemplary embodiment, the short-circuit lines 511 can be made substantially longer. An inductance caused by the short-circuit lines 511 can be made larger.

As for the switch 509, various switching devices which can be turned ON and OFF electrically are used, for example, a diode switch or a MEMS (Micro Electro Mechanical Systems) switch. A PIN diode is used as the switch 509 in this exemplary embodiment. The switches 509 can be controlled to turn ON or OFF with the short-circuit lines 511 from an outside of the antenna device 500 through the bias lines 507. When all of the switches are turned OFF, a radiation pattern of the antenna device 500 remains non-directional because there is no disturbance on the electric field of the coaxial line 501.

When one of the switches 509 is turned ON, the radiation pattern of the antenna device 500 has a directivity because the electric field of the coaxial line 501 is disturbed. The directivity of the antenna 500 can be switched by switching the switches 509.

Figure 13C:
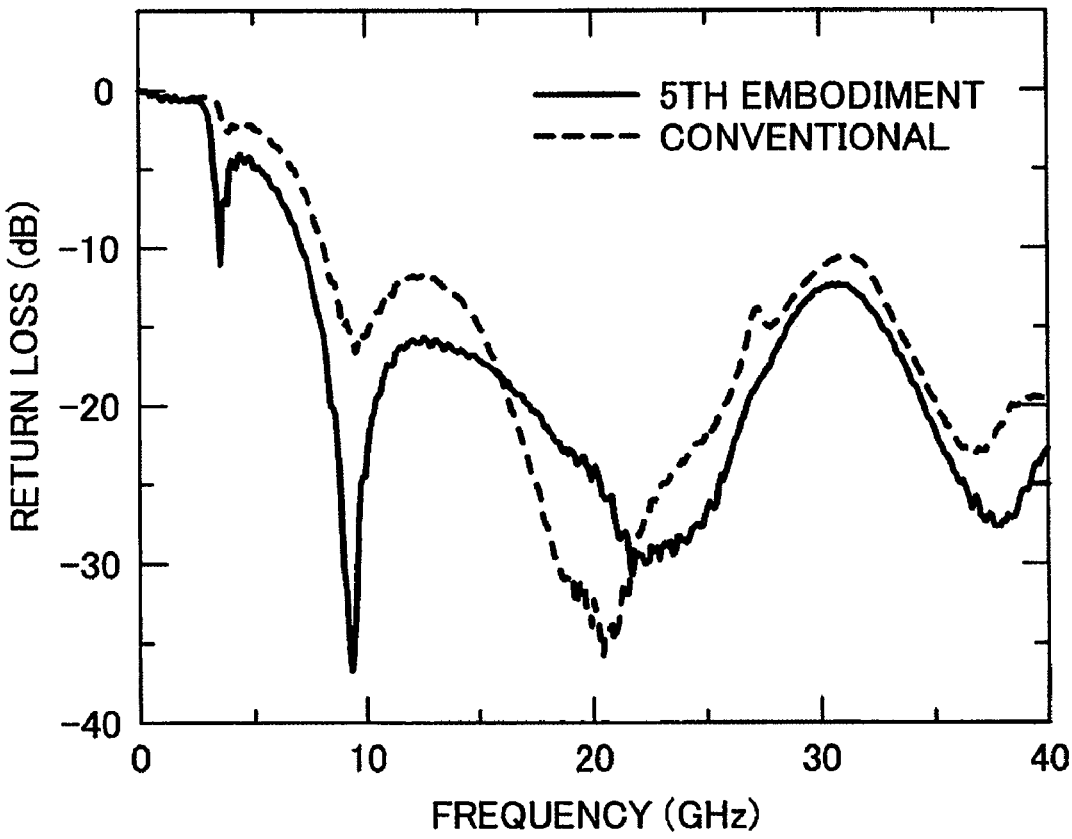
FIG. 13C illustrates a graph of a return loss of the antenna device of 13A.

FIG. 13C illustrates a graph of a return loss of the antenna device 500 according to the fifth exemplary embodiment. A solid line shows a characteristic of the antenna device 500. A dotted line shows a characteristic of a conventional antenna device in which the short-circuit line 511 is connected with a straight line. Referring to FIG. 13C, the return loss of the antenna device according to the fifth exemplary embodiment has a lower return loss in a range below 10 GHz and is found to be improved. It is possible to improve the radiation characteristic in the lower frequency range because the short-circuit lines 511 are made substantially longer than the conventional antenna device and the inductance caused by the short-circuit lines 511 is made substantially larger.

Figure 5:
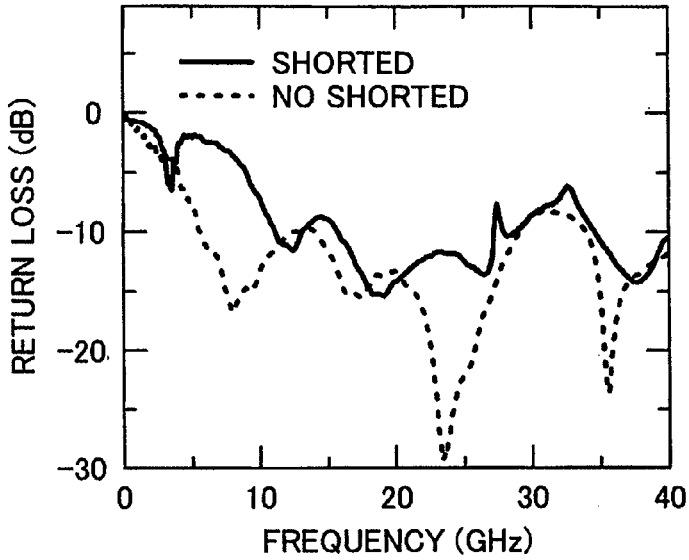
FIG. 5 BACKGROUND ART
FIG. 5 illustrates a return loss characteristic of the variable-directivity antenna device of FIG. 4A.
Figure 6:
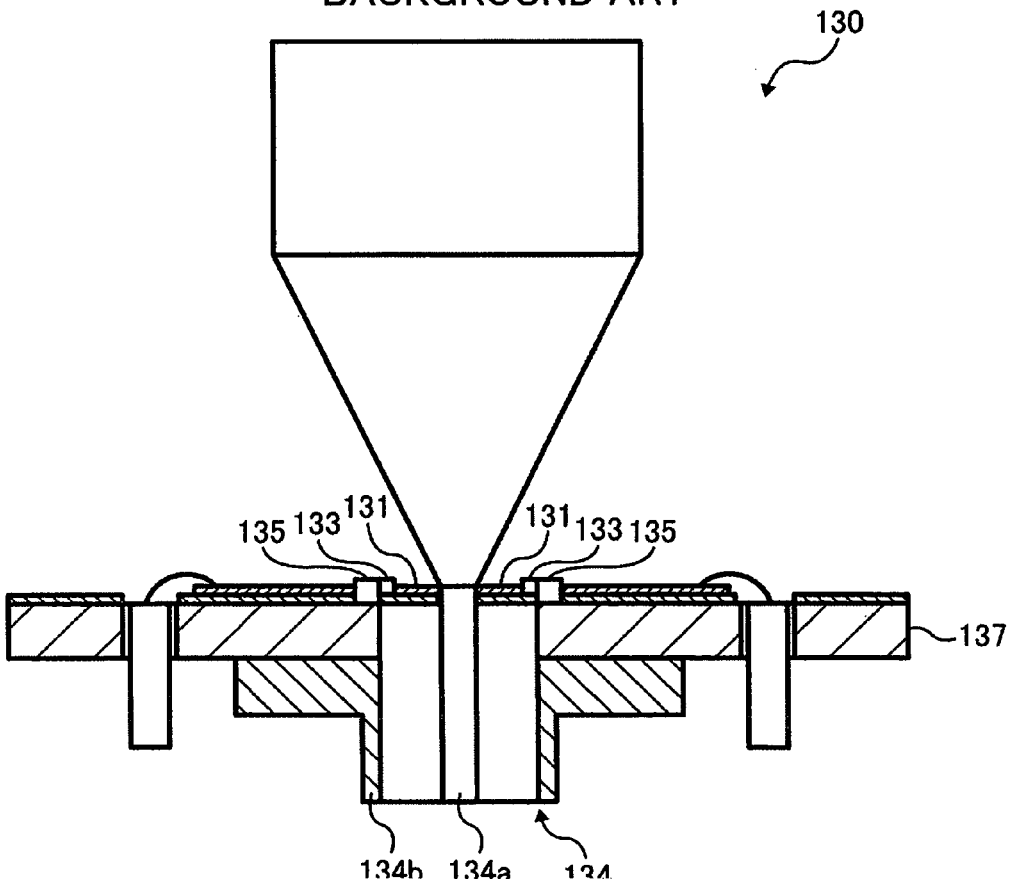
FIG. 6 BACKGROUND ART
FIG. 6 illustrates a cross-sectional view of another known variable-directivity antenna device.
Figure 7:
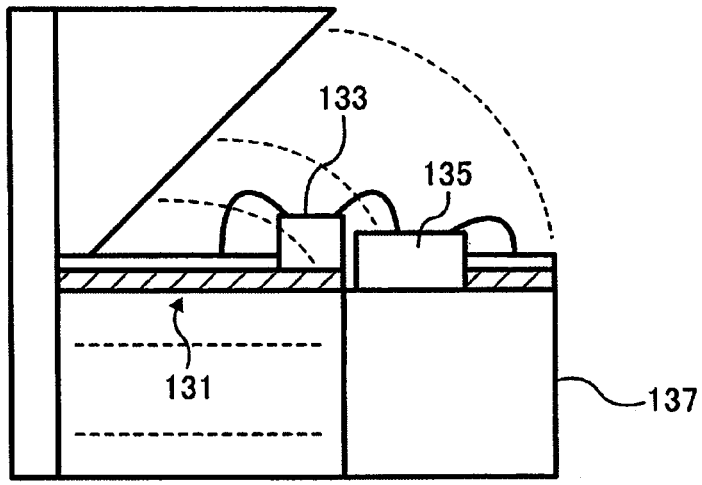
FIG. 7 BACKGROUND ART
FIG. 7 illustrates a cross-sectional view of the variable-directivity antenna device of FIG. 6 having active short-circuit with wirings.
Figure 8:
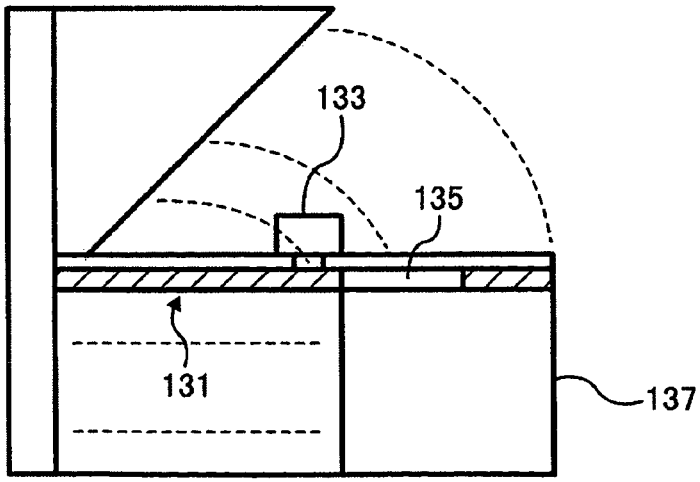
FIG. 8 BACKGROUND ART
FIG. 8 illustrates a cross-sectional view of the variable-directivity antenna device of FIG. 6 with no wiring.

The characteristic of the return loss of FIG. 13C is slightly different from the return loss FIG. 5. This is due to a difference of the configuration of the antenna devices. More specifically, the characteristic of the return loss of FIG. 13C is measured using the antenna device 500 having the dielectric film but the characteristic of the return loss of FIG. 5 is measured using the antenna device with no dielectric film.

Figure 14A:
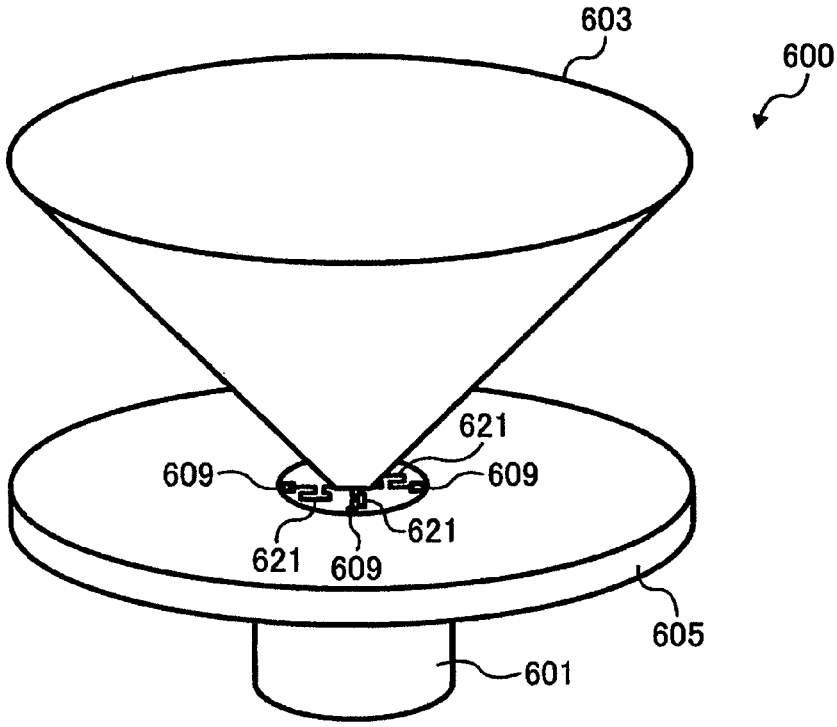
FIGS. 14A and 14B illustrate a relevant part of an antenna device according to a sixth exemplary embodiment.
Figure 14B:
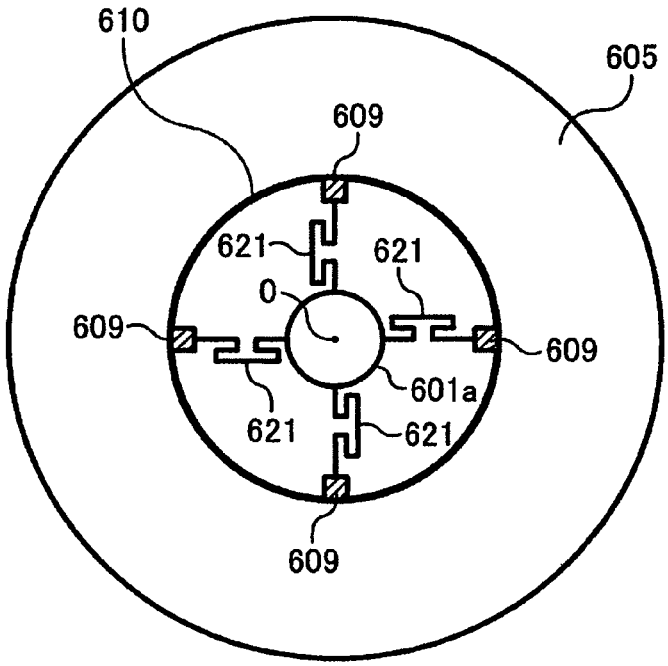

FIG. 14A and 14B illustrate a relevant part of an antenna device 600 according to a sixth exemplary embodiment. FIG. 14A illustrates an oblique perspective view of the antenna device 600 according to the sixth exemplary embodiment. The antenna device 600 is a disk-corn-shaped antenna having a radiating element 603 and a ground plate 605. FIG. 14B illustrates a top view of the ground plate 605 of the antenna device 600 of FIG. 14A. The antenna device 600 is a variable-directional antenna to which an electromagnetic power is fed by a coaxial line 601.

As shown in FIG. 14B, each short-circuit line 621 includes a meander-shaped line in each of four directions to connect to each switch 609 so that a length of the short-circuit line 621 is extended substantially. In this exemplary embodiment, a center of the coaxial line 601, a connection point of the short-circuit line 621 and a inner conductor 601*a* and a connection point of the short-circuit line 621 and an outer line 610 are arranged on a straight line.

An electric field direction of TEM mode (Transverse Electromagnetic mode) matches with a shorting direction so that a length of the short-circuit line 521 is made substantially longer without disturbing other electric field in the coaxial line 601 than the electric field in the shorting direction. Therefore, it is possible to improve the radiational characteristic in the lower frequency range. As for the switch 609, the switching devices which can be turned ON and OFF electrically are used, for example, a diode switch or a MEMS switch similar to the fifth exemplary embodiment.

Figure 15A:
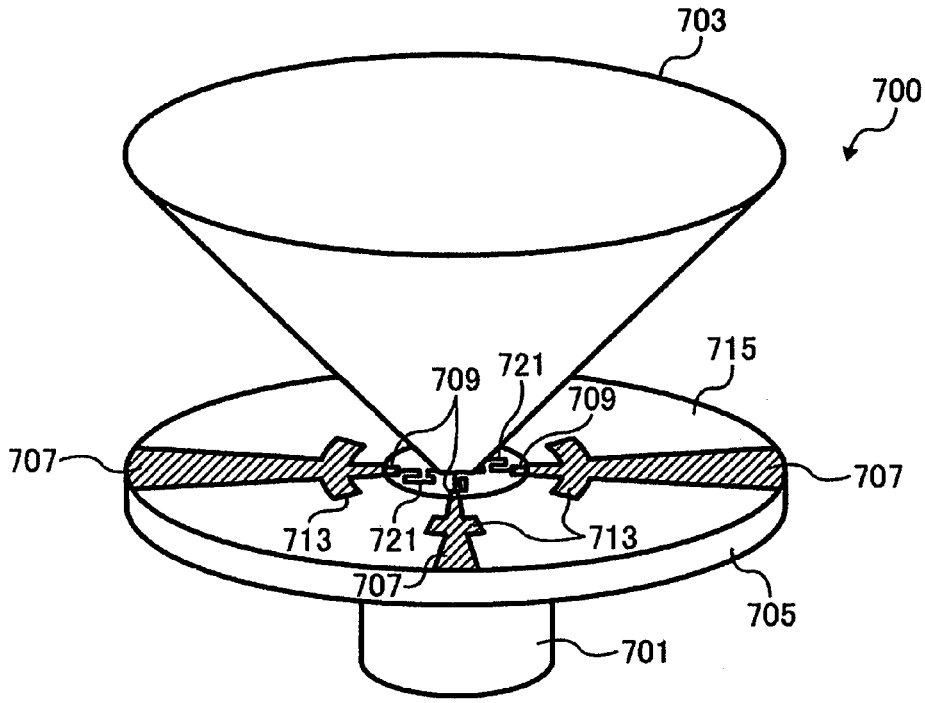
FIGS. 15A and 15B illustrate a relevant part of an antenna device according to a seventh exemplary embodiment.
Figure 15B:
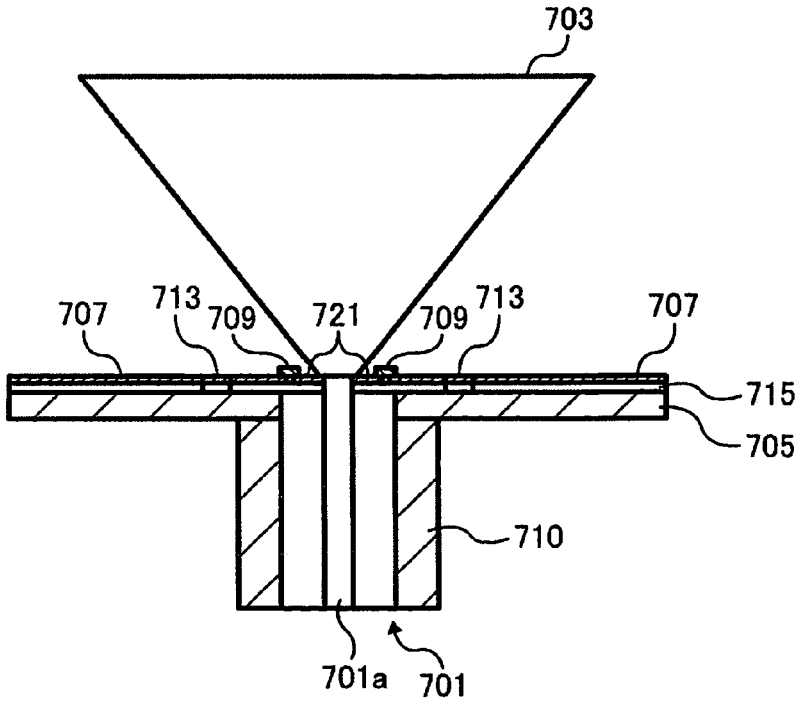

FIGS. 15A and 15B illustrate a relevant part of an antenna device 700 according to a seventh exemplary embodiment. FIG. 15A illustrates an oblique perspective view of the antenna device 700 according to the seventh exemplary embodiment. FIG. 15B illustrates a cross-sectional view of a ground plate 705 of the antenna device 700 of FIG. 15A. The antenna device 700 is a disk-corn-shaped antenna having a radiating element 703 and a ground plate 705. The antenna device 700 is a variable-directional antenna to which an electromagnetic power is fed by a coaxial line 701.

The antenna device 700 has both features of the antenna devices 500 and 600 according to the fifth and sixth exemplary embodiments, respectively. Namely, bias lines 707, switches 709, short-circuit lines 711 and a dielectric film 715 are arranged on the ground plate 705. The dielectric film 715 includes a dielectric material and is attached on the ground plate 705. Moreover, each short-circuit line 721 has a meander-shaped line in each of four directions to connect to each switch 709 so that a length of the short-circuit line 721 is extended substantially.

Two expanding effects of short-circuit line, which is substantially extending the length of the short-circuit line, will be obtained according to the seventh exemplary embodiment. Namely, one expanding effect of short-circuit line is achieved by configuring the grounded point of the short-circuit line 721 to be located at a point which is on an outer side of an outer conductor 710 of the coaxial line 701 from the center of the coaxial line 701 and over the ground plate 705. Another expanding effect of short-circuit line is achieved by the formation of the short-circuit line with a meander-shaped line. An inductance of the short-circuit line 721 is increased so that a radiation characteristic can be improved in the lower frequency range.

Figure 16A:
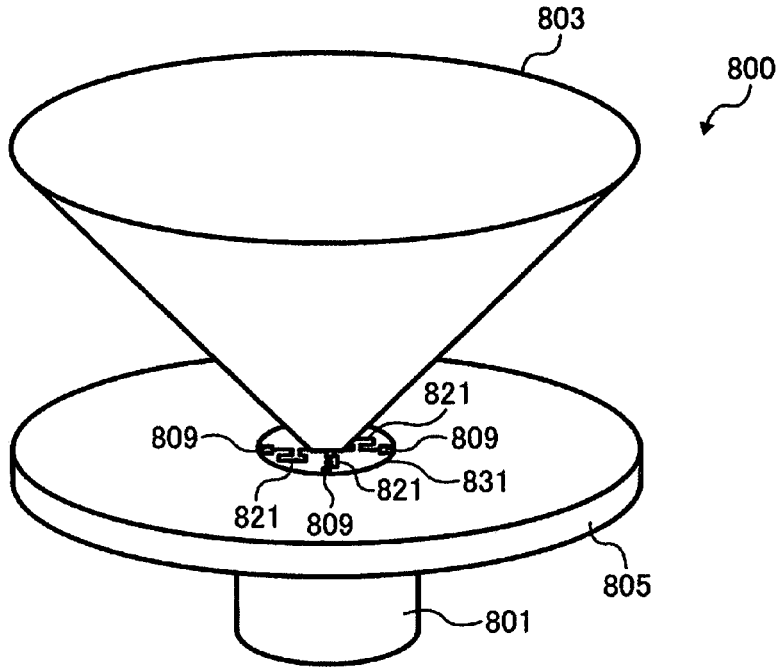
FIGS. 16A and 16B illustrate a relevant part of an antenna device according to an eighth exemplary embodiment.
Figure 16B:
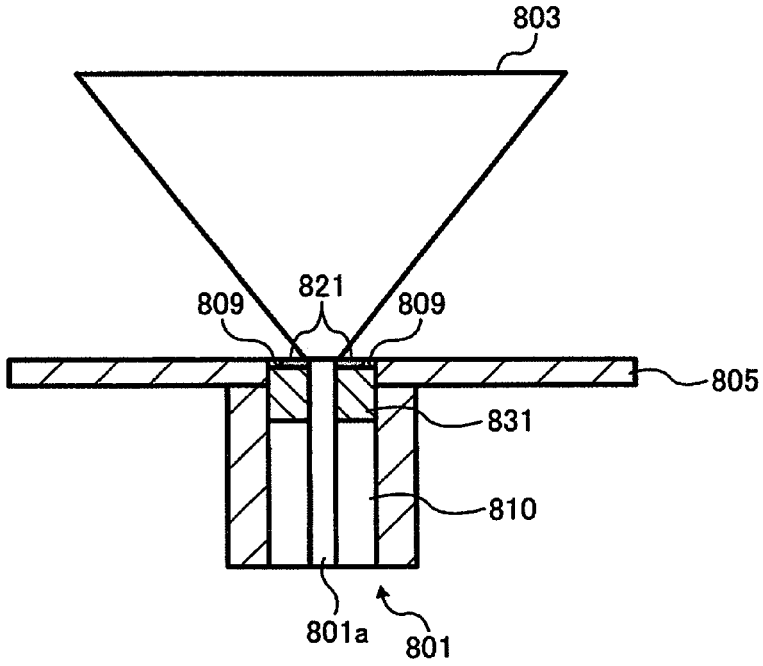

FIGS. 16A and 16B illustrate a relevant part of an antenna device 800 according to an eighth exemplary embodiment. FIG. 16A illustrates an oblique perspective view of the antenna device 800 according to the eighth exemplary embodiment. FIG. 16B illustrates a cross-sectional view of a ground plate 805 of the antenna device 800 of FIG. 16A. The antenna device 800 is a disk-corn-shaped antenna having a radiating element 803 and a ground plate 805. The antenna device 800 is a variable-directional antenna to which an electromagnetic power is fed by a coaxial line 801.

The antenna device 800 includes a high magnetic permeability material, for example ferrite, which is the sole difference from the antenna device 500 of the fifth exemplary embodiment. The high magnetic permeability material is arranged at a position of the coaxial line 801 close to short-circuit lines 821. A permeability value of the high magnetic permeability material is determined to be grater than "1".

A inductance of the antenna device 800 is increased by the installation of the high magnetic permeability material having a permeability more than "1" at a position close to short-circuit lines 821 and by the expanding effect of the short-circuit line formed to have a meander-shaped line. As a result, an inductance of the short-circuit line 821 is increased so that a radiation characteristic in the lower frequency range is improved. Japanese laid open patent application JPOP No. H10-154911 states that an impedance value depends on the magnetic permeability of the coaxial line.

In the antenna devices of the sixth, seventh and eighth exemplary embodiments, PIN diodes are used as switching devices. When all of the switches are turned OFF, a radiation pattern of the antenna device (600, 700, 800) remains non-directional. When one of the switches is turned ON, the radiation pattern of the antenna device (600, 700, 800) possess a directivity. Thus, the directivity of the antenna 600, 700 and 800 can be switched by switching the switch 609, 709 and 809, respectively.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments and examples may be combined with each other and/or substituted for each other within the scope of this disclosure and appended claims.

This patent specification is based on Japanese patent applications, No. 2005-204642 filed on Jul. 13, 2005 and No. 2005-209267 filed on Jul. 19, 2005 in the Japan Patent Office, the entire contents of which are incorporated by reference herein.

What is claimed is:

1. An antenna device, comprising:

a non-directional antenna having a radiating element and a ground plate;

a coaxial line configured to feed an electromagnetic power to the non-directional antenna, said coaxial line including an inner conductor and an outer conductor;

a dielectric film arranged on the ground plate, including a dielectric material;

a short circuit line arranged on the dielectric film, formed of a conductive pattern and configured to connect the inner conductor of the axial line to the outer conductor of the coaxial line; and a switch arranged at a portion of the short circuit line to switch a state between a non-shorted state and a shorted state.

2. The antenna device of claim 1, further comprising:

a capacitor configured to connect the short circuit line to the ground plate at a radio frequency and including a dielectric layer formed of the dielectric film.

3. The antenna device of claim 2, wherein one electrode of the capacitor is formed on a side of the dielectric film with a conductive pattern made in a process in which the short circuit line is made and the other electrode of the capacitor is formed at an opposite side of the dielectric film of the capacitor.

4. The antenna device of claim 3, wherein the other electrode of the capacitor is a part of the ground plate.

5. The antenna device of claim 3, wherein the ground plate is formed by extending the other electrode of the capacitor.

6. The antenna device of claim 1, further comprising:

a thin dielectric film thinner than the dielectric film formed on the ground plate; and a capacitor including a dielectric layer formed of the thin dielectric film and configured to connect the short circuit line to the ground plate at a radio frequency, wherein one electrode of the capacitor is formed on a side of the dielectric film with a conductive pattern made in a process in which the short circuit line is made and the other electrode of the capacitor is formed at opposite side of the thin dielectric film of the capacitor.

7. An antenna device, comprising:

a non-directional antenna having a radiating element and a ground plate;

a coaxial line configured to feed an electromagnetic power to the non-directional antenna, said coaxial line including an inner conductor and an outer conductor;

a dielectric film arranged on the ground plate and formed of dielectric material;

a short circuit line arranged on the dielectric film, formed of a conductive pattern and configured to connect the inner conductor of the coaxial line to the outer conductor of the coaxial line; and a capacitor configured to connect an outer portion of the short circuit to the ground plate at a radio frequency at a position outside an outer conductor of the coaxial line from the center of the coaxial line over the ground plate.

8. The antenna device of claim 7, wherein a center axis of the coaxial line, a connection point of the short circuit and the inner conductor, and a connection point of the short circuit line and the outer conductor are arranged on a straight line.

9. The antenna device of claim 7, wherein the short circuit line is formed to have a meander-shaped line.

10. An antenna device, comprising:

a non-directional antenna having a radiating element and a ground plate;

a coaxial line configured to feed an electromagnetic power to the non-directional antenna, said coaxial line including an inner conductor and an outer conductor;

a short circuit line arranged on a dielectric film, formed of a conductive pattern and having a length substantially longer than an interval between the inner conductor of the coaxial line and the outer conductor of the coaxial line; and a switch arranged at a portion of the short circuit line to switch a state between a non-shorted state and a shorted state.

11. The antenna device of claim 10, wherein the coaxial line includes a magnetic permeability material which has a permeability value greater than "1" at a position close to the short-circuit line in the coaxial line.

* * * * *